US005814777A

United States Patent [19]

Green et al.

[11] Patent Number: 5,814,777

[45] Date of Patent: Sep. 29, 1998

[54] CABLE INTERLOCK SYSTEM FOR CIRCUIT BREAKERS

[75] Inventors: Russell B. Green, Douglasville; Bernard DiMarco, Lilburn, both of Ga.

[73] Assignee: Siemens Energy & Automation,Inc., Alpharetta, Ga.

[21] Appl. No.: 625,465

[22] Filed: Mar. 29, 1996

[51] Int. Cl.[6] ..... H01H 9/26

[52] U.S. Cl. ..... 200/50.33

[58] Field of Search ..... 200/50.01, 50.32, 200/50.33, 50.35, 50.36; 361/615

[56] References Cited

U.S. PATENT DOCUMENTS

| | | | |
|---|---|---|---|
| 3,303,300 | 2/1967 | Turnbull | 200/50 |
| 3,705,280 | 12/1972 | Harms | 200/50.33 |
| 3,939,725 | 2/1976 | Fisher | 74/503 |
| 4,370,635 | 1/1983 | Carroll et al. | 335/20 |
| 4,374,597 | 2/1983 | Mochida | 292/8 |
| 4,400,599 | 8/1983 | Rickmann | 200/50 |
| 4,419,549 | 12/1983 | Osborne | 200/50 |
| 4,526,057 | 7/1985 | Mochida et al. | 74/501 |
| 4,626,638 | 12/1986 | Samples et al. | 200/331 |
| 4,788,453 | 11/1988 | Bohnen et al. | 307/119 |
| 4,902,859 | 2/1990 | Witzmann et al. | 200/50 |
| 5,193,666 | 3/1993 | Markowski et al. | 200/331 |
| 5,227,952 | 7/1993 | Romano et al. | 361/339 |
| 5,270,505 | 12/1993 | Magiera | 200/331 |
| 5,272,296 | 12/1993 | Robarge et al. | 200/331 |
| 5,319,168 | 6/1994 | Hutko et al. | 200/331 |
| 5,422,453 | 6/1995 | Smith et al. | 200/329 |
| 5,428,196 | 6/1995 | Beatty, Jr. et al. | 200/329 |
| 5,486,978 | 1/1996 | Fishovitz | 200/50.33 |

*Primary Examiner*—Matthew V. Nguyen

[57] ABSTRACT

A cable interlock system for preventing at least two circuit breakers from being closed at the same time, comprising a first circuit breaker having a first operating handle, wherein the first operating handle is adapted to close or open the first circuit breaker, a second circuit breaker having a second operating handle, wherein the second operating handle is adapted to close or open the second circuit breaker, a first mounting bracket that is attached or secured to or otherwise associated with the first circuit breaker, a first lever arm movably attached or secured to or otherwise associated with the first mounting bracket, a second mounting bracket that is attached or secured to or otherwise associated with the second circuit breaker, a second lever arm movably attached or secured to or otherwise associated with the second mounting bracket, a cable assembly having one end adapted to be connected to the first lever arm of the first mounting bracket and having another end adapted to be connected to the second lever arm of the second mounting bracket, wherein said cable assembly and the first lever arm and the second lever arm operate together so as to prevent the first operating handle and the second operating handle from both being in the closed position.

18 Claims, 2 Drawing Sheets

CABLE INTERLOCK SYSTEM FOR CIRCUIT BREAKERS

BACKGROUND OF THE INVENTION

1. Field of the Invention

This invention relates to a cable interlock system for two (2) circuit breakers that prevents both circuit breakers from being closed at the same time.

2. Description of Related Art

Certain industrial power applications may require two circuit breakers to be interlocked to prevent them from being closed at the same time. For example, industrial molding facilities and other manufacturing plants use back-up power systems to continue operations if the electric utility service goes off line. When the circuit breaker is closed for electric utility service, inadvertently closing a circuit breaker from a back-up power system by placing the operator handle in its ON position could have potentially undesired effects. It is therefore necessary to interlock the two circuit breakers so as to avoid such potential effects.

There are various types of known interlock designs. For example, a "walking beam" interlock is disclosed in U.S. Pat. No. 4,902,859, and assigned to Siemens Energy & Automation, Inc., which details a mechanical interlock for interlocking two circuit breakers such that only one of the circuit breakers is on at a given time. The interlock is also configured so that it permits both circuit breakers to be off at the same time. The interlock includes a pivoting rocker arm and a linkage assembly associated with each breaker, wherein the rocker arm and linkage assemblies cooperate to transfer motion between the tie bars of the circuit breakers.

Another type of mechanical interlock is the "pivoted beam" interlock, these interlocks have also been used between two circuit breakers to prevent both breakers from being in their closed or open positions at the same time. Each circuit breaker includes a stationary contact and a movable contact blade. The circuit breakers also include plungers that extend through openings in the housings of the circuit breakers. The movable contact and blade is associated with each plunger so that the plunger moves outwardly when the contacts are closed and the plunger moves inwardly when the contacts are open. The plungers engage the pivoted beam on each side of its pivot so as to prevent the contacts from being open or closed at the same time.

There are, however, some disadvantages of such systems. For example, in some applications the circuit breakers must be partially disassembled to install such systems. Other systems may also require the circuit breakers to be mounted at the same fixed distance. For "walking beam" type systems, additional space may be required behind the circuit breaker mounting surface to connect the "walking beam". Moreover, at least certain of the known systems may not be useable with circuit breakers having different frame sizes.

Consequently, there is a need for an interlock system that is relatively easy to install on the front housing of circuit breakers. In addition, there is also a need for an interlock system that may be mounted at varying distances from the circuit breakers. Finally, there is also a need for an interlock system that may be used to interlock circuit breakers having different size frames.

SUMMARY OF THE INVENTION

It is an object of the present invention to overcome the problems of other known interlock systems.

It is another object of the present invention to provide an interlock system for preventing at least two circuit breakers from being closed at the same time, comprising: a first mounting bracket adapted to be associated with a first circuit breaker; a first lever arm adapted to be movably associated with the first mounting bracket; a second mounting bracket adapted to be associated with a second circuit breaker; a second lever arm adapted to be movably associated with the second mounting bracket; a cable assembly having one end adapted to be connected to the first lever arm and having another end adapted to be connected to the second lever arm, wherein the cable assembly, the first lever arm and the second lever arm are adapted to operate together so as to prevent the first and second circuit breakers from both being in the closed position.

It is still another object of the present invention to provide an interlock system for preventing at least two circuit breakers from being closed at the same time, comprising: a first mounting bracket means for a first circuit breaker means; a first lever arm means for being movably associated with the first mounting bracket means; a second mounting bracket means for a second circuit breaker means; a second lever arm means for being movably associated with the second mounting bracket means; a cable assembly means having one end for connection to the first lever arm means and having another end for connection to the second lever arm means, wherein the cable assembly means, the first lever arm means and the second lever arm means operate together so as to prevent the first and second circuit breaker means from both being in the closed position.

It is another object of the present invention to provide a cable interlock system for preventing at least two circuit breakers from being closed at the same time, comprising a first circuit breaker having a first operating handle, wherein the first operating handle is adapted to close or open the first circuit breaker, a second circuit breaker having a second operating handle, wherein the second operating handle is adapted to close or open the second circuit breaker, a first mounting bracket that is attached or secured to or otherwise associated with the first circuit breaker, a first lever arm movably attached or secured to or otherwise associated with the first mounting bracket, a second mounting bracket that is attached or secured to or otherwise associated with the second circuit breaker, a second lever arm movably attached or secured to or otherwise associated with the second mounting bracket, a cable assembly having one end adapted to be connected to the first lever arm of the first mounting bracket and having another end adapted to be connected to the second lever arm of the second mounting bracket, wherein said cable assembly and the first lever arm and the second lever arm operate together so as to prevent the first operating handle and the second operating handle from both being in the closed position.

It is still another object of the present invention to provide an interlock system for preventing at least two circuit breakers from being closed at the same time, comprising: a first circuit breaker means having a first operating handle means, wherein the first operating handle means is for closing or opening the first circuit breaker means; at least a second circuit breaker means having at least a second operating handle means, wherein the at least a second operating handle means is for closing or opening the at least second circuit breaker means; a first lever arm means for contacting the first operating handle means; a first mounting bracket means for connecting to the first circuit breaker means and for supporting the first lever arm means; at least a second lever arm means for contacting the at least a second operating handle means; a second mounting bracket means for connecting to the at least a second circuit breaker means and for supporting the at least a second lever arm means; a cable means having one end for connection to the first lever arm means of the first mounting bracket means and having another end for connection to the at least a second lever arm means of the at least a second mounting bracket means, wherein the cable means and the first lever arm means and the at least a second lever arm means operate together so as to prevent the first operating handle and the at least a second operating handle from both being in the closed position.

These and other objects, advantages and features of the present invention will be readily understood and appreciated with reference to the detailed description of preferred embodiments discussed below together with the accompanying drawings.

DETAILED DESCRIPTION OF PREFERRED EMBODIMENT

Figure 2:
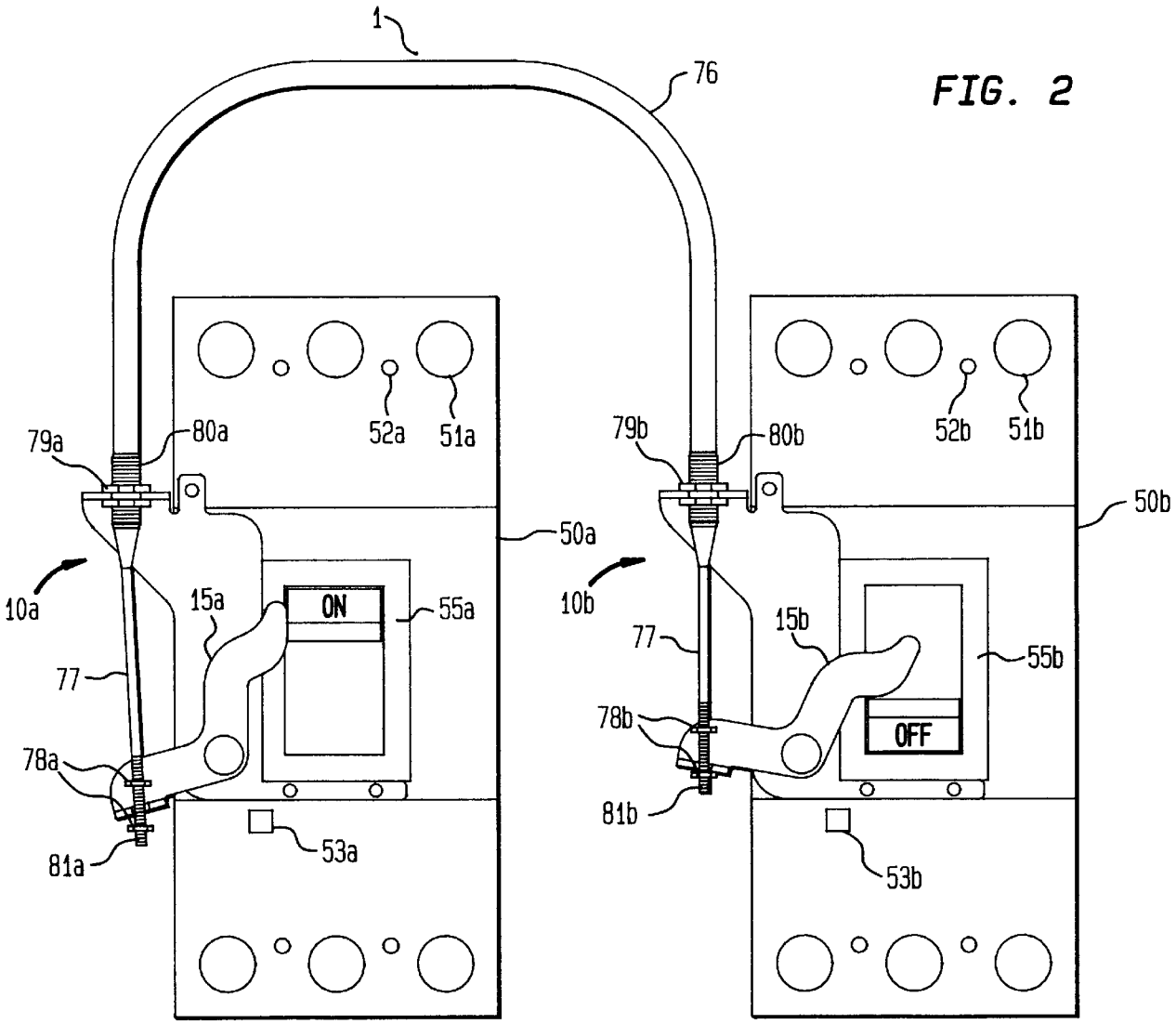
FIG. 2 is a drawing of the cable interlock system of the present invention.

As shown in FIG. 2, the cable interlock system 1 of the present invention comprises two interlock assemblies 10*a* and 10*b* connected by a flexible utility cable assembly 75. Of course, any other suitably appropriate flexible connecting apparatus may also be used to connect the interlock assemblies 10*a* and 10*b*. Each of the interlock assemblies 10*a* and 10*b* is the same for circuit breakers 50*a* and 50*b* having the same frame size. Of course, with the system of the present invention, the circuit breakers 50*a* and 50*b* may also have different frame sizes. The circuit breaker unit 50*a* comprises circuit breaker lug openings or apertures 51*a*, circuit breaker mounting openings or apertures 52*a* and a push-to-trip button or switch 53*a*. The circuit breaker unit 50*b* also comprises circuit breaker lug openings or apertures 51*b*, circuit breaker mounting openings or apertures 52*b* and a push-to-trip button or switch 53*b*.

Figure 1A:
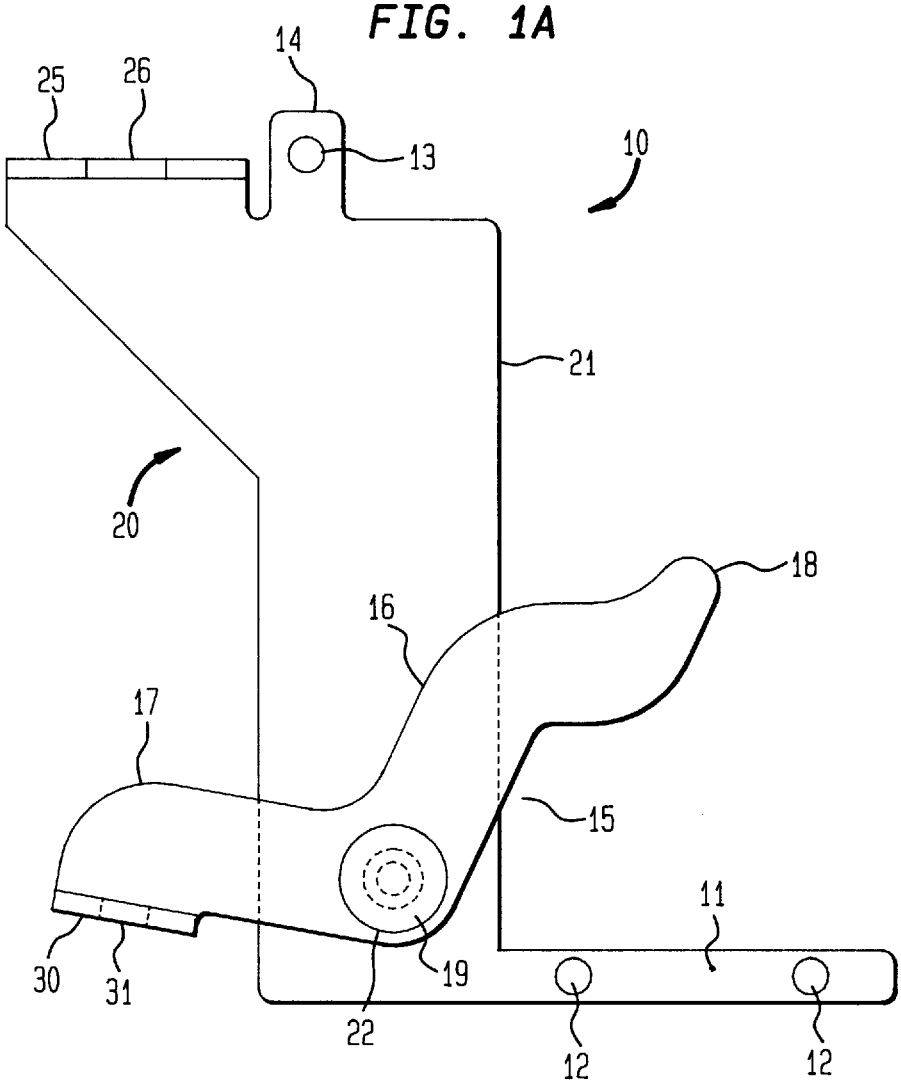
FIG. 1A is a drawing of some components of a mounting bracket assembly of the cable interlock system.

Referring to FIG. 1A, the drawing shows the components of an interlock assembly 10, which corresponds to the mounting bracket assemblies 10*a* and 10*b* of FIG. 2. The mounting bracket assembly comprises a mounting bracket 20, which is made from steel but which may also be made from other suitably appropriate materials. The mounting bracket 20 has attachment openings or apertures 12 and 13 in an attachment leg 11, which is perpendicular to the main body 21 of the mounting bracket 20. The attachment openings or apertures 12 and 13 are used to attach, secure or otherwise associate the mounting bracket assembly 10 with a circuit breaker unit. The mounting bracket assemblies 10*a* and 10*b* may be attached or secured to or otherwise associated with the circuit breaker units 50*a* and 50*b* by using threaded cutting screws, or any other suitably appropriate fastening apparatus, at attachment openings or apertures 12 and 13 of the mounting bracket assembly 20. Each mounting bracket 20 also provides an embossed fastening point 19 for a shoulder rivet 22.

Each mounting bracket assembly 10 also comprises a lever arm 15, which is preferably made from steel but which may also be made from any other suitably appropriate materials. The lever arm 15 may be attached or secured to or otherwise associated with the mounting bracket assembly 10 using a shoulder rivet 22 and a nylon washer (not shown) on each side of the lever arm 15. The shoulder rivet 22, which is made of steel but which may also be made of other suitably appropriate materials, is used to attach, secure or otherwise associate the lever arm 15 with the mounting bracket 20 by inserting it in the embossed opening or aperture 19 of the mounting bracket assembly 20. The shoulder rivet 22 is used to movably attach, secure or otherwise retain the lever arm 15 and to allow the lever arm 15 to rotate with respect to the mounting bracket 20. The mounting bracket 20 supports the forces of the lever arm 15 and one end of a flexible utility cable assembly 75 when the cable interlock system 1 is used to interlock at least two circuit breaker units 50*a* and 50*b*.

The flexible utility cable assembly 75, such as that manufactured by Cablecraft of Tacoma, Wash., has a first threaded swivel-conduit fitting 80*a* on one end and a second threaded swivel-conduit 80*b* on its other end. Of course, any suitably appropriate flexible connecting apparatus may also be used to connect the interlock assemblies 10*a* and 10*b* of the system of the present invention. The flexible utility cable 75 also has a cable sleeve 76 and a stainless steel cable 77. Of course, the cable 77 may also be made of any other suitably appropriate materials. The cable 77 has a threaded end rod 81*a* and another threaded end rod 81*b*. Each lever arm 15*a* and 15*b* may be attached, secured to or otherwise associated with the flexible utility cable assembly 75 by using a prevailing torque nut 78*a* on each side of a flange opening or aperture 31 in the cable mounting flange 30 of the lever arm 15.

Figure 1B:
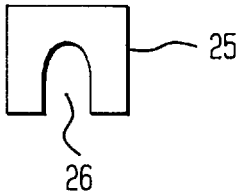
FIG. 1B shows a u-shaped flange of the mounting bracket assembly of the cable interlock system.
Figure 1C:
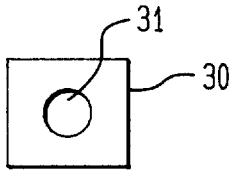
FIG. 1C shows a flange of a lever arm of the mounting bracket assembly of the cable interlock system.

More specifically, as shown in FIGS. 1A and 1C the cable mounting flange or segment 30 of the lower arm 17 is formed at a perpendicular angle or other suitably appropriate oblique angle to the rest of the lever arm 15. Each threaded end rod 81*a* and 81*b* may be attached to lever arms 15*a* and 15*b*, respectively, by inserting them in their respective flange openings or apertures 31 and securing them by using prevailing torque nuts 78*a* and 78*b* on each side of the flange openings or apertures 31. The flexible utility cable assembly 75 is also attached or secured to or otherwise associated with the mounting brackets 15*a* and 15*b* by using jam-nuts 79*a* and 79*b* on each side of the flexible cable threaded conduits 80*a* and 80*b*, which are received by the unshaped flanges 25 having openings or apertures 26 as shown in FIGS. 1A, 1B and 2.

The lever arms 15*a* and 15*b* interface with the operating handles 55*a* and 55*b*, respectively, of the circuit breaker units 50*a* and 50*b* in the following way when they act to interlock the circuit breaker units 50*a* and 50*b*. The side of the operating handle 55*a* will act as a blocking device for the lever arm 15*a* when the operating handle 55*a* of circuit breaker unit 50*a* is in the ON position and the lever arm 15*a* has rotated through the travel path of the operating handle 55*a* of the circuit breaker unit 50*a* so as to contact or rest against the side of the operating handle 55*a*. More specifically, lever arm 15 has arm portions 16 and 17, and upper arm portion 16 has a foot 18 for contacting the operating handle. Thus, the side of the operating handle 55*a* acts to block rotational movement of the lever arm 15*a*. At the same time, the mounting bracket assembly 10*b* associated with circuit breaker unit 50*b* provides that the operating handle 15*b* of the circuit breaker unit 50*b* remains in the OFF position by blocking the travel path of the operating handle 55*b* so as to prevent the operating handle 55*b* from being moved to the ON position.

As discussed, the cable interlock system 1 is designed to prevent two connected circuit breaker units 50*a* and 50*b* from being closed in the ON position at the same time, while also allowing both circuit breaker units 50*a* and 50*b* to be open in the OFF position at the same time. Referring to FIG. 2, the cable interlock system of the present invention does this in the following way.

When both circuit breaker units 50*a* and 50*b* are in the OFF position, the cable interlock system 1 is in a free state. As circuit breaker unit 50*b* is closed, in which case the operating handle is moved to or toggled to the ON position, the operating handle 55*a* engages lever arm 15*b* and rotates it counterclockwise. As the operating handle 55*a* is toggled to the ON position so as to close the circuit breaker unit 50*b*, the operating handle 55*a* slides by the lever arm 15*b* so as to block the lever arm 15*b* from rotating clockwise. Also, as lever arm 15*b* rotates counterclockwise, it pulls the connecting cable 77 in a clockwise direction. The lever arm 15*a* rotates clockwise to a blocking position of the operating handle 55*a*, which blocks the operating handle 55*a* of circuit breaker unit 50*a* from moving to or being toggled to the ON position. Additionally, if either circuit breaker unit 50*a* or 50*b* trips, a condition which corresponds to the operating handle being in a middle position, the cable interlock system 1 still prevents the operating handle of the other circuit breaker unit from being moved or toggled to the ON position.

While the present invention has been described in connection with what are the most practiced and preferred embodiments as currently contemplated, it should be understood that the present invention is not limited to the disclosed embodiments. Accordingly, the present invention is intended to cover various modifications and equivalent arrangements, methods and structures that are within the spirit and scope of the claims.

What is claimed is:

1. An external interlock system for preventing at least two circuit breakers from being closed at the same time, comprising:

a first mounting bracket adapted to be associated with a first circuit breaker;

a first lever arm adapted to be movably associated with said first mounting bracket;

a second mounting bracket adapted to be associated with a second mounting bracket;

a second lever arm adapted to be movably associated with said second mounting bracket; and a single cable assembly having one end adapted to be connected to said first lever arm and having another end adapted to be connected to said second lever arm, wherein said single cable assembly, said first lever arm and said second lever arm are adapted to operate together so as to prevent the second circuit breaker from being moved from an open position to a closed position when the first circuit breaker is in one of the closed position and a tripped position.

2. An external interlock system for preventing at least two circuit breakers from being closed at the same time, comprising:

a first mounting bracket means for a first circuit breaker means;

a first lever arm means for being movably associated with said first mounting bracket means;

a second mounting bracket means for a second circuit breaker means;

a second lever arm means for being movably associated with said second mounting bracket means; and a single cable assembly means having one end for connection to said first lever arm means and having another end for connection to said second lever arm means, wherein said single cable assembly means, said first lever arm means and said second lever arm means are adapted to operate together so as to prevent the second circuit breaker means from being moved from an open position to a closed position when the first circuit breaker is in the closed position.

3. An external interlock system for preventing at least two circuit breakers from being closed at the same time, comprising:

a first circuit breaker having a first operating handle, wherein said first operating handle is adapted to close or open said first circuit breaker;

at least a second circuit breaker having at least a second operating handle, wherein said at least a second operating handle is adapted to close or open said at least second circuit breaker;

a first mounting bracket that is attached or secured to or otherwise associated with said first circuit breaker;

a first lever arm movably attached or secured to or otherwise associated with said first mounting bracket;

at least one second mounting bracket that is attached or secured to or otherwise associated with said at least a second circuit breaker;

at least one second lever arm movably attached or secured to or otherwise associated with said at least one second mounting bracket; and a single cable assembly having one end adapted to be connected to said first lever arm of said first mounting bracket and having another end adapted to be connected to said at least a second lever arm of said at least a second mounting bracket, wherein said single cable assembly and said first lever arm and said at least a second lever arm operate together so as to prevent said at least one second operating handle from being moved from an open position to a closed position when said first lever arm is in one of the closed position and a tripped position.

4. An interlock system according to claim 3, wherein said single cable assembly further comprises a first threaded conduit fitting and a first threaded end rod segment on one end of said single cable assembly, and a second threaded conduit fitting and a second threaded end rod segment on another end of said single cable assembly, wherein said first mounting bracket has a flange and an opening therein adapted to connect said first threaded conduit fitting of said single cable assembly, wherein said first lever arm has a flange and an opening therein adapted to connect said first threaded end rod segment, wherein said at least a second mounting bracket has a flange and an opening therein adapted to connect said second threaded conduit fitting of said single cable assembly, and wherein said at least a second lever arm has a flange and an opening therein adapted to connect said second threaded end rod segment.

5. An external interlock system for preventing at least two circuit breakers from being closed at the same time, comprising:

a first circuit breaker means having a first operating handle means, wherein said first operating handle means is for closing or opening said first circuit breaker means;

at least a second circuit breaker means having at least a second operating handle means, wherein said at least a second operating handle means is for closing or opening said at least second circuit breaker means;

a first lever arm means for contacting said first operating handle means;

a first mounting bracket means for connected to said first circuit breaker means and for supporting said first lever arm means;

at least a second lever arm means for contacting said at least a second operating handle means;

a second mounting bracket means for connected to said at least a second circuit breaker means and for supporting said at least a second lever arm means and;

a single cable means having one end for connection to said first lever arm means of said first mounting bracket means and having another end for connection to said at least a second lever arm means of said at least a second mounting bracket means, wherein said single cable means and said first lever arm means and said at least a second lever arm means operate together so as to prevent said at least a second operating handle from being moved from an open position to a closed position when said first lever arm means is in one of the closed position and a tripped position.

6. An interlock system according to claim 5, wherein said single cable means further comprises a first conduit means and a first end rod means on one end of said single cable means, and a second conduit means and a second end rod means on another end of said single cable means, wherein said first mounting bracket means has a flange and an opening therein for receiving and connecting said first conduit means of said single cable means, wherein said first lever arm means has a flange and an opening therein for connecting said first end rod means, wherein said at least a second mounting bracket has a flange and an opening therein for receiving and connected said second conduit means of said single cable means, and wherein said at least a second lever arm means has a flange and an opening therein for receiving and connecting said second end rod means.

7. An external cable interlock system for preventing at least two circuit breakers from both being closed, comprising:

a first circuit breaker assembly comprising a first transfer assembly and a first operating handle, wherein said first operating handle is adapted to close or open said first circuit breaker assembly, and wherein said first transfer assembly is adapted to contact said first operating handle;

a second circuit breaker assembly comprising a second transfer assembly and a second operating handle, wherein said second operating handle is adapted to close or open said second circuit breaker assembly, and wherein said second transfer assembly is adapted to contact said second operating handle; and a single cable assembly having one end adapted for association with said first transfer assembly and having another end adapted for association with said second transfer assembly, wherein said one end of said single cable assembly and said first transfer assembly cooperate with said first operating handle, and said another end of said single cable assembly and said second transfer assembly cooperate with said operating handle so as to prevent the second circuit breaker assembly from being moved from an open position to a closed position when said first circuit breaker assembly is in one of the closed position and a tripped position.

8. An external cable interlock system for preventing at least two circuit breakers from both being closed, comprising:

a first circuit breaker assembly means comprising a first transfer assembly means and a first operating handle, wherein said first operating handle is for closing or opening said first circuit breaker assembly means, and wherein said first transfer assembly means is for contacting said first operating handle;

a second circuit breaker assembly means comprising a second transfer assembly means and a second operating handle, wherein said second operating handle is for closing or opening said second circuit breaker assembly means, and wherein said second transfer assembly is for contacting said second operating handle; and a single cable assembly means having one end for associating with said first transfer assembly means and having another end for associating with said second transfer assembly means, wherein said one end of said single cable assembly and said first transfer assembly cooperate with said first operating handle, and said another end of said single cable assembly and said second transfer assembly cooperate with said operating handle so as to prevent the second circuit breaker assembly from being moved from an open position to a closed position when said first circuit breaker assembly is in one of the closed position and a tripped position.

9. An external cable interlock apparatus for preventing at least two circuit breakers from both being closed, comprising:

a first transfer assembly for use with a first circuit breaker assembly having a first operating handle adapted to open or close the first circuit breaker assembly, wherein said first transfer assembly is adapted to contact said first operating handle;

a second transfer assembly for use with a second circuit breaker assembly having a second operating handle adapted to open or close the second circuit breaker assembly, wherein said second transfer assembly is adapted to contact said second operating handle; and a single cable assembly having one end adapted for association with said first transfer assembly and having another end adapted for association with said second transfer assembly, wherein said one end of said single cable assembly and said first transfer assembly cooperate with said first operating handle, and said another end of said single cable assembly and said second operating handle transfer assembly cooperate with said second operating handle so as to prevent the second circuit breaker assembly from being moved from an open position to a closed position when said first circuit breaker assembly is in one of the closed position and a tripped position.

10. An external cable interlock means for preventing at least two circuit breakers from both being closed, comprising:

a first transfer assembly means for use with a first circuit breaker assembly having a first operating handle for opening or closing the first circuit breaker assembly, wherein said first transfer assembly means is for contacting the first operating handle;

a second transfer assembly means for use with a second circuit breaker assembly having a second operating handling for opening or closing the second circuit breaker assembly, wherein said second transfer assembly means is for contacting said second operating handle; and a single cable assembly means having one end for connecting with said first transfer assembly means and having another end for connecting with said second transfer assembly means, wherein said one end of said single cable assembly means and said first transfer assembly means cooperate with said first operating handle, and said another end of said single cable assembly means and said second transfer assembly means cooperate with said second operating handle so as to prevent the second circuit breaker assembly from being moved from an open position to a closed position when said first circuit breaker assembly is in one of the closed position and a tripped position.

11. An external cable interlock assembly for preventing at least a first and second circuit breaker assemblies from both being closed, the first circuit breaker assembly having a first operating handle that is adapted to close or open the first circuit breaker assembly, the second circuit breaker assembly having a second operating handle that is adapted to close or open the second circuit breaker assembly, said cable interlock assembly comprising:

a first transfer assembly associated with the first circuit breaker assembly that is adapted to contact the first operating handle;

a second transfer assembly associated with the second circuit breaker assembly that is adapted to contact the second operating handle; and a single cable assembly having one end adapted for association with said first transfer assembly and having another end adapted for association with said second transfer assembly;

wherein said one end of said single cable assembly and said first transfer assembly cooperate with said first operating handle, and said another end of said single cable assembly and said second transfer assembly cooperate with said operating handle so as to prevent the second circuit breaker assembly from being moved from an open position to a closed position when said first circuit breaker assembly is in one of the closed position and a tripped position.

12. An external cable interlock assembly means for preventing at least a first and second circuit breaker assemblies from both being closed, the first circuit breaker assembly having a first operating handle that is adapted to close or open the first circuit breaker assembly, the second circuit breaker assembly having a second operating handle that is adapted to close or open the second circuit breaker assembly, said cable interlock assembly comprising:

first transfer assembly means associated with the first circuit breaker assembly for contacting the first operating handle;

a second transfer assembly means associated with the second circuit breaker assembly for contacting the second operating handle; and a single cable assembly means having one end for being associated with said first transfer assembly means and having another end for being associated with said second transfer assembly means, wherein said one end of said single cable assembly means and said first transfer assembly means cooperate with the first operating handle, and said another end of said single cable assembly means and said second transfer assembly means cooperate with the second operating handle for preventing the second circuit breaker assembly from being moved from an open position to a closed position when said first circuit breaker assembly is in one of the closed position and a tripped position.

13. The system of claims 7, 9 or 11, wherein said first and second transfer assemblies each comprise a lever arm that is adapted to rotate so as to provide interlocking.

14. The system of claims 8, 10 or 12, wherein said first and second transfer assembly means each comprise a lever arm means for rotating so as to provide interlocking.

15. The interlock system according to claim 1, wherein said first mounting bracket is mounted to a front surface of said first circuit breaker, and said second mounting bracket is mounted to a front surface of said second circuit breaker.

16. The interlock system according to claim 2, wherein said first mounting bracket is mounted to a front surface of said first circuit breaker means, and said second mounting bracket is mounted to a front surface of said second circuit breaker means.

17. The interlock system according to claim 3, wherein said first mounting bracket is mounted to a front surface of said first circuit breaker, and said second mounting bracket is mounted to a front surface of said second circuit breaker.

18. The interlock system according to claim 5, wherein said first mounting bracket means is mounted to a front surface of said first circuit breaker means, and said second mounting bracket means is mounted to a front surface of said second circuit breaker means.

* * * * *